US008240141B2

(12) United States Patent
Cros et al.

(10) Patent No.: US 8,240,141 B2
(45) Date of Patent: Aug. 14, 2012

(54) HYDRAULIC SYSTEM PROTECTED FROM EXTERNAL IMPACTS

(75) Inventors: Francois Cros, Toulouse (FR); Roger Morvan, Gratentour (FR)

(73) Assignee: Airbus Operations SAS, Toulouse (FR)

( * ) Notice: Subject to any disclaimer, the term of this patent is extended or adjusted under 35 U.S.C. 154(b) by 825 days.

(21) Appl. No.: 12/349,202

(22) Filed: Jan. 6, 2009

(65) Prior Publication Data

US 2009/0242705 A1 Oct. 1, 2009

(30) Foreign Application Priority Data

Jan. 7, 2008 (FR) ..... 08 00071

(51) Int. Cl.
*B64C 13/00* (2006.01)
*F16K 17/20* (2006.01)

(52) U.S. Cl. ..... 60/403; 244/226

(58) Field of Classification Search ..... 60/403; 244/226, 76 R, 78.1, 99.2, 99.9; 91/511, 91/514

See application file for complete search history.

(56) References Cited

U.S. PATENT DOCUMENTS 2,493,906 A * 1/1950 Wishart ..... 60/403
2,670,750 A * 3/1954 Reynolds ..... 91/448
2,751,751 A * 6/1956 Strayer ..... 60/403
3,861,209 A 1/1975 Amies
5,100,082 A * 3/1992 Archung ..... 60/403
7,600,715 B2 * 10/2009 Matsui ..... 60/405

FOREIGN PATENT DOCUMENTS

DE 103 55 250 A1 6/2005
FR 2 757 223 A 6/1998

OTHER PUBLICATIONS

Tuttle F L et al., "F-15 S/MTD IFPC fault tolerant design." (May 21, 1990), pp. 501-506.

Preliminary Search Report, FR 08 00071 000, dated Oct. 20, 2008.

* cited by examiner

*Primary Examiner* — Thomas E Lazo
(74) *Attorney, Agent, or Firm* — Perman & Green, LLP

(57) ABSTRACT

A hydraulic system includes at least one hydraulic circuit with at least one pump, one or more consumer equipment units, at least one HP discharge line comprising at least one bypass, the bypass being located between the pump and the units, at least one return line including at least one bypass, the bypass being located between a tank and the units. The hydraulic system further includes at least one closure element on the at least one HP line between the bypass and the units, and at least one nonreturn valve on the at least one return line between the bypass and the units. The closure element is placed automatically in the closed position when a break of the HP line is detected downstream of the closure element of the HP line.

7 Claims, 5 Drawing Sheets

| | Maximum normal service flow rate (l/min) | Incipient fracture (l/min) | Example of fuse rating |
|---|---|---|---|
| | 74 | 111 | 85/105 |
| | 20 | 92 | 25/35 |
| | 55 | 85 | 60/75 |
| | 35 | 64 | 40/50 |
| | <1 | 17 | 5/10 |

| | Maximum normal service flow rate (l/min) | Incipient fracture (l/min) | Example of fuse rating |
|---|---|---|---|
| | 62 | 105 | 70/90 |
| | 42 | 77 | 48/58 |
| | <1 | 31 | 5/10 |

HYDRAULIC SYSTEM PROTECTED FROM EXTERNAL IMPACTS

BACKGROUND

1. Field

The disclosed embodiments belong to the field of hydraulic systems used on board aircraft for controlling moving elements such as aerodynamic control surfaces and portions of the landing gear. More particularly, the disclosed embodiments relate to a hydraulic system protected against the consequences of the breakage of certain lines due to an external impact.

2. Brief Description of Related Developments

On most modern transport aircraft, numerous moving parts are moved by actuators using power transported in a pressurized hydraulic fluid.

The aerodynamic control surfaces are the main systems moved by hydraulic actuators, their satisfactory operation and their fluid supplies by hydraulic distribution systems are essential, and any uncontrolled failure is liable to imperil the aircraft.

For these safety reasons, the hydraulic systems of an aircraft, comprising hydraulic power generation systems, hydraulic distribution systems and actuators, are arranged in architectures which attempt, inter alia, to limit the consequences of potential failures of the various components of said systems and, in all cases, to prevent a probable failure from having consequences that are liable to jeopardize the integrity of the aircraft concerned.

Principles common to all known architectures, at least for those used on board civilian aircraft required to meet stringent certification standards, consist in arranging a plurality of independent hydraulic circuits, in general three circuits, each circuit possibly comprising two or more of certain components, for example two pumps for generating hydraulic pressure (redundancy rules), and furthermore, in arranging the components of said circuits on board the aircraft so that the risk of damage to two or more redundant circuits or components, due to a single damaging event, is improbable (segregation rule).

However, in the case of an external event, such as midair collision or missile impact on one of the two wings of the aircraft airfoil, the risk is high of simultaneously cutting lines of all the hydraulic circuits having lines on said wing, and the hydraulic circuits affected by the event rapidly lose hydraulic fluid and become unusable. In this case, since the hydraulic pressure is no longer distributed to the systems which participate in controlling the aircraft in flight, flight control of the aircraft is considered impossible.

To contend with the loss of all the hydraulic fluid of the hydraulic circuits in case of breakage of a line during a midair collision affecting a wing tip or stabilizer root, one solution consists in inserting hydraulic fuses in the lines to said wing tips or to the stabilizer root.

However, this solution is not satisfactory because the locations of said hydraulic fuses are unsuitable for isolating the hydraulic circuit or circuits from the damage caused by the impact of a missile or any destructive device on one of the aircraft wings, between the root of said wing at the fuselage and the wing tip.

An appropriate system for protecting the hydraulic circuits in the wings of the airfoil is necessary in order to preserve the capacity to control the aircraft by the protected hydraulic systems.

The disclosed embodiments describe a hydraulic system which comprises at least one hydraulic circuit, said hydraulic circuit comprising:

at least one hydraulic pump for generating a high pressure flow of a hydraulic fluid of the at least one hydraulic circuit, said pump defining a direction upstream of the hydraulic circuit, one or more consumer equipment units of a first zone using the hydraulic fluid, said consumer equipment units defining a direction downstream of the hydraulic circuit, at least one HP discharge line in which the hydraulic fluid flows from the pump to the consumer equipment units, said HP discharge line comprising at least one bypass to consumer equipment units of a second zone, in which second zone the hydraulic pump is located, said bypass being located between, on the one hand, the pump and, on the other hand, the consumer equipment units, at least one return line in which the hydraulic fluid flows from the consumer equipment units to a hydraulic tank, said return line comprising at least one bypass to consumer equipment units of a second zone, said bypass being located between, on the one hand, the tank and, on the other hand, the consumer equipment units.

According to the disclosed embodiments, the hydraulic system further comprises:

at least one closure element, on the at least one HP discharge line of the at least one hydraulic circuit between, on the one hand, the bypass and, on the other hand, the consumer equipment units, at least one nonreturn valve on the at least one return line of the at least one hydraulic circuit between, on the one hand, the bypass and, on the other hand, the consumer equipment units, and opposing the flow of the fluid from the pump to the consumer equipment units.

Said at least one closure element comprises an open position in which the hydraulic fluid flows freely in the HP discharge line from upstream to downstream of the closure element in a normal operating mode of the hydraulic circuit and comprises a closed position in which the hydraulic fluid is prevented from flowing from upstream to downstream of the closure element, the closure element being placed automatically in the closed position when a break of the HP discharge line is detected downstream of the closure element of said HP discharge line.

In a first embodiment, the at least one closure element is at least one fuse which is normally open and which closes, without external action, when a flow rate of fluid passing through the line at said fuse is higher than a predefined threshold flow rate, characteristic of the rating of the fuse concerned.

When the hydraulic system comprises at least two fuses on a HP discharge line, the second fuse is downstream of the first.

The distance between two consecutive fuses on a HP discharge line is determined so that:

the rating of the fuse is at least higher than the maximum normal operating flow rate of all the consumer equipment units located downstream of the fuse, the rating of the fuse is lower than the flow rate in case of breakage of the HP discharge line downstream of the fuse and upstream of the next downstream fuse.

The number of fuses required and their arrangements are determined, for a given temperature of the hydraulic fluid, to detect a breakage at any point of the HP discharge line.

For example, the first zone comprising one or more consumer equipment units is an aircraft wing.

In another embodiment, the at least one closure element is a controlled valve.

The valve is controlled when a signal from at least one pressure sensor detects a pressure lower than a predefined threshold in a HP discharge line at a point close to a consumer equipment unit among the furthest from the controlled valve.

Preferably, the at least one sensor is positioned on a HP discharge line close to one tip of an aircraft wing.

The disclosed embodiments also relate to an aircraft comprising at least two hydraulic circuits, each circuit supplying consumer equipment units which are specific to it and in which at least one circuit, comprises lines in the two wings of said aircraft.

BRIEF DESCRIPTION OF THE DRAWINGS

The detailed description of the disclosed embodiments is provided with reference to the figures which show.

DETAILED DESCRIPTION OF THE DISCLOSED EMBODIMENTS

According to the disclosed embodiments, a hydraulic system comprises at least one hydraulic circuit supplied by at least one hydraulic pump and comprising lines which are located in a zone liable to damage by an impact of a destructive device, for example a missile impact.

The disclosed embodiments are described in the case of a hydraulic system of an aircraft in which a missile impact simultaneously damages all the hydraulic circuits in a wing of the aircraft, forming a first zone. The disclosed embodiments may also be applicable to hydraulic systems in any fixed or mobile device, in particular in onshore or naval machines.

Figure 1:
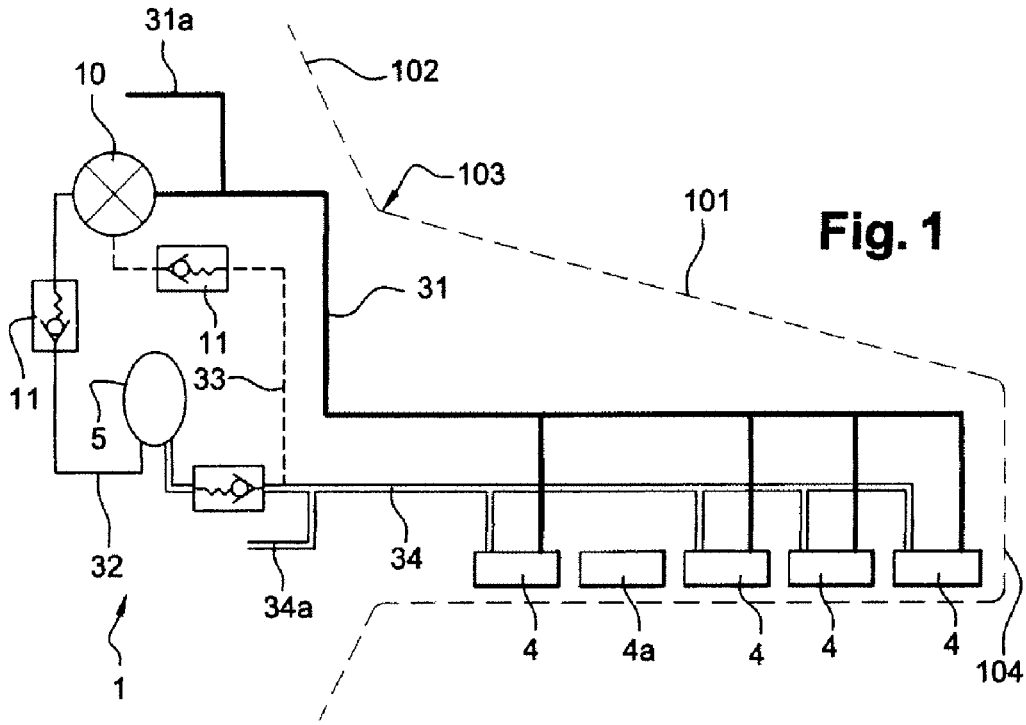
FIG. 1, a schematic example of an architecture of a hydraulic circuit of an aircraft, according to the prior art, FIG. 2, an example of a hydraulic system on a right wing of an aircraft, comprising closure elements according to an embodiment of the invention, FIG. 3, an example of a hydraulic system on a right wing of an aircraft, comprising closure elements according to another embodiment of the invention, FIG. 4, an example of the architecture of a hydraulic system on a twin-engined aircraft comprising three hydraulic circuits, FIG. 5, an example of the architecture of a hydraulic system on a four-engined aircraft comprising three hydraulic circuits, FIG. 6*a*, an example illustration of the positions of the closure elements on a hydraulic circuit and the associated sections of hydraulic circuits in the right wing of a four-engined aircraft, FIG. 6*b*, a table of flow rate characteristics of sections of a hydraulic circuit and of the associated fuses, FIG. 7*a*, an example illustration of the positions of the closure elements on a hydraulic circuit and the associated sections of hydraulic circuits in the left wing of the same four-engined aircraft, FIG. 7*b*, a table showing the flow rate characteristics of sections of a hydraulic circuit and of the associated fuses.
Figure 2:
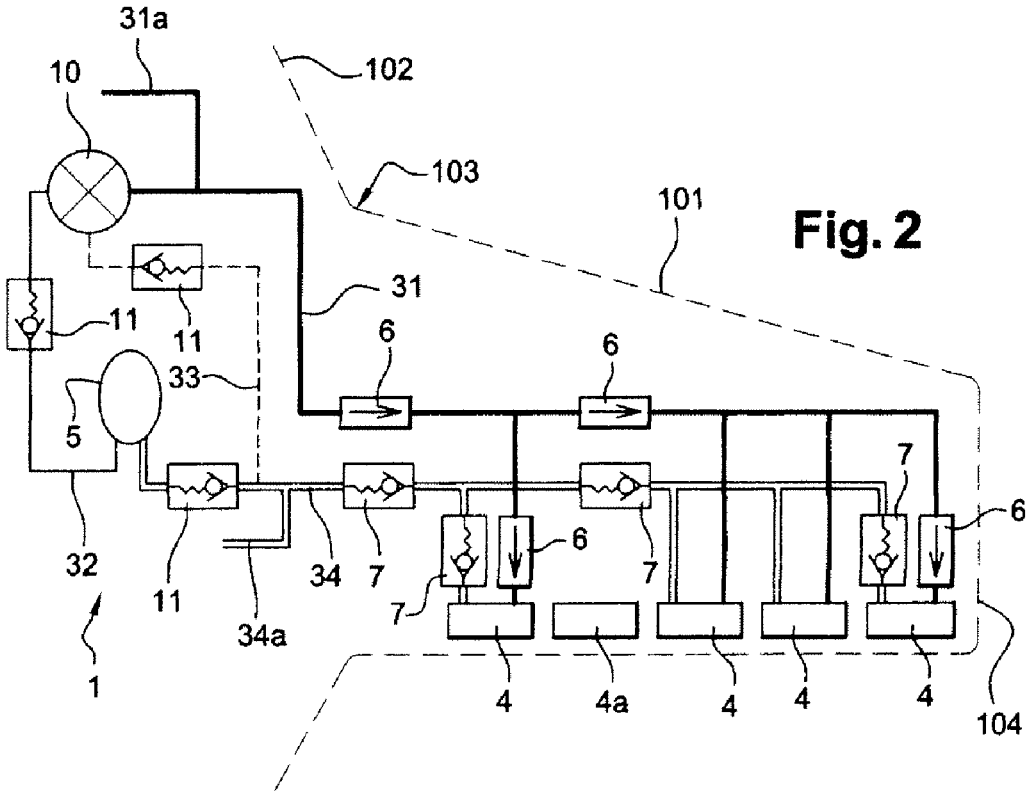
Figure 3:
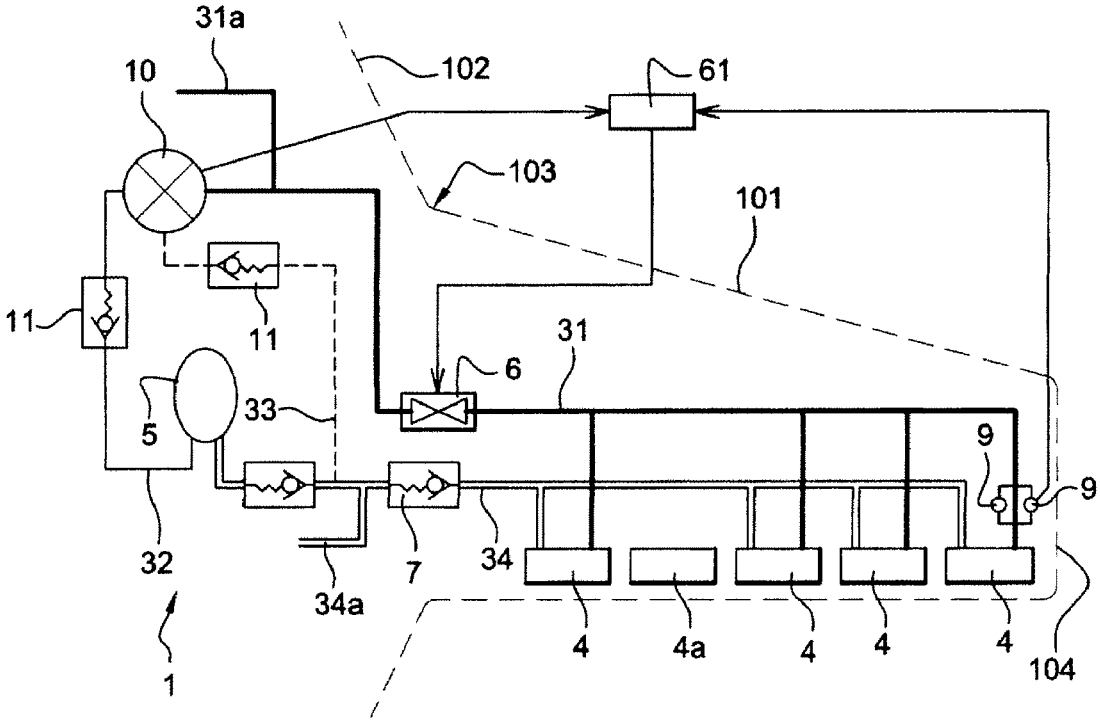

FIG. 1 shows a schematic example of an architecture of a hydraulic circuit 1 of an aircraft according to the prior art. FIGS. 2 and 3 show the schematic example of the same architecture of the hydraulic circuit 1 according to the invention. In FIGS. 1, 2 and 3, the same units or circuit portions are identified by the same reference numerals.

The hydraulic circuit 1 comprises a hydraulic pump 10 which is driven, in the example considered, by a propulsion engine of the aircraft (not shown).

The hydraulic circuit 1 comprises lines of a hydraulic distribution system in which a hydraulic fluid flows in closed circuit, supplying hydraulic power to a portion of the consumer equipment units 4 of the wing considered, such as actuators, hydraulic motors, etc., necessary for example for flight controls, for lift devices, for engine thrust reversers and for landing gear systems. Some consumer equipment units 4*a* of a wing 101 are supplied with hydraulic power by other hydraulic circuits not shown.

The hydraulic circuit 1 also comprises a hydraulic tank 5, a pressurized tank which contains a reserve of hydraulic fluid.

Said tank is suitable for compensating for losses of hydraulic fluid, in particular due to inevitable microleaks in a hydraulic system, and for compensating for variations in the fluid level caused by the operation of the units and by temperature variations in service, which are sources of variations in fluid volume.

The tank 5 is therefore an essential element of a hydraulic circuit and in particular its volume, which characterizes a capacity of the tank to compensate for losses of hydraulic fluid.

The pump 10 is connected to the hydraulic circuit via lines in which the hydraulic fluid flows from the consumer equipment units to the pump via the tank and lines in which the hydraulic fluid leaves the pump toward the consumer equipment units.

In the examples in FIGS. 1, 2, and 3, the pump 10 comprises, according to a known pump architecture for a given hydraulic circuit, four main lines:

a first line 31, called HP discharge line, (shown in FIGS. 1 to 3 by a thick solid line) corresponding to an offtake of hydraulic fluid at high pressure from the pump 10, to the consumer equipment units 4 of the wing 101;

a bypass 31*a* on the HP discharge line forms an offtake toward other consumer equipment units not shown, for example to the other wing or to other parts of the aircraft;

a second line 32, called suction line, (shown in FIGS. 1 to 3 by a thin solid line) corresponding to the arrival of hydraulic fluid at low pressure toward the pump 10, a fluid arriving from the consumer equipment units 4 via the tank 5;

a third line 33, called drain line, (shown in FIGS. 1 to 3 by a broken line) corresponding to an offtake of hydraulic fluid at low pressure from a drainage sump of the pump 10. The drain line sends, to the tank, the hydraulic fluid reaching the sump of the pump 10 due to internal leaks in said pump;

a fourth line 34, called return line, (shown in FIGS. 1 to 3 by a double solid line) corresponding to a return of hydraulic fluid at low pressure toward the tank 5, a fluid arriving from the consumer equipment units 4;

a bypass 34*a* on the return line 34 forms an offtake to other consumer equipment units not shown, for example toward the other wing or to other parts of the aircraft.

Said consumer equipment units 4 are generally distributed at various locations of the aircraft and in particular on each wing 101 of the airfoil, between a root 103, on the side of a fuselage 102, and a tip 104 of the wing 101, on the side opposite the fuselage 102.

In the description, the expression "HP discharge line" generally means all or parts of the HP discharge lines, that is a main line which leaves from the pump 10 and/or secondary distribution, bypass or equipment unit lines connected to the main line or to another secondary line.

The expression "return line" generally means all or parts of the return lines, that is a main line reaching the tank 5 from the pump 10 and/or secondary distribution, bypass or equipment unit lines connected to the main line or to another secondary line.

In the description, at a point of a line considered, the term downstream means the portion of the line which is located on the side of the consumer equipment unit 4 with regard to the point considered, and the term upstream means the portion of the line which is located on the side of the pump 10 with regard to the point considered.

In a manner known per se, each of the drain 33, suction 32 and return 34 lines is provided with at least one nonreturn valve 11, each nonreturn valve being arranged on the corresponding line so that the hydraulic fluid flows freely in the line from the pump 10 to the hydraulic circuit and cannot flow in the reverse direction.

According to the disclosed embodiments, the hydraulic circuit 1 further comprises at least one closure element 6 arranged on the HP discharge line 31, downstream of the bypass 31*a*, as shown in FIG. 2.

A closure element 6 consists of means comprising a position called open in which the flow of the fluid in the HP discharge line 31 is allowed and a closed position in which the flow of the fluid in the HP discharge line 31 is prohibited at said closure element.

According to the disclosed embodiments, in normal operation, the closure element 6 is open. When a break is detected in the HP discharge line 31, the nearest closure element 6 upstream of the break on the circuit is identified and then closed.

The closure element 6, when placed in the closed position, serves to isolate a portion of the line, located downstream on the line considered, without interrupting the flow of fluid into the consumer equipment units 4 located upstream. Thus, when the aircraft is affected by a missile impact, the closure element 6 isolates the leak upstream thereof, thereby preventing a significant loss of fluid which could not be compensated for by the tank 5. Sufficient fluid thus remains so that the consumer equipment units supplied by the rest of the hydraulic circuit affected, in particular the consumer equipment units supplied via the bypass 31*a*, remain supplied with pressurized fluid and therefore operational.

At any point, the HP discharge line 31 comprises a cross section adapted to the maximum flow rate that may be necessary considering the consumer equipment units 4 that can operate simultaneously downstream of the point considered in the HP discharge line 31. At the root 103, the cross section is generally a maximum to allow a fluid flow equal to a maximum sum of the simultaneous flow rates of the consumer equipment units 4 which said HP discharge line supplies, said consumer equipment units usually having different instantaneous flow rates at a given moment.

When the HP discharge line is considered at various points of the wing 101 span 103, the sum of the flow rates to be considered to determine the cross section decreases due to the decrease in the number of consumer equipment units 4 to be supplied. For this reason, a cross section of the HP discharge line decreases steadily between the first consumer equipment unit 4 supplied, located near the root 103, and the last, located near the tip 104 of the wing 101, to avoid transporting unnecessary masses of lines and hydraulic fluid.

The hydraulic circuit 1 further comprises at least one nonreturn valve 7, located downstream of the bypass 34*a*, preferably arranged substantially in the same zone as the at least one closure element 6, on the return line 34, as shown in FIG. 2.

Thus, the closure element 6/nonreturn valve 7 combination isolates the hydraulic circuit between an upstream side and a downstream side, both for the HP discharge circuit 31 and for the return circuit 34.

In a first embodiment, the closure element is a hydraulic fuse.

A hydraulic fuse is a closure element having self-contained operation, which is normally open and which closes, without external action, when a flow rate of fluid passing through the line at said fuse is higher than a predefined threshold flow rate, characteristic of the rating of the fuse considered.

A hydraulic fuse, of which the threshold flow rate is, on the one hand, higher than the maximum consumption flow rate of the consumer equipment units 4 located downstream and, on the other hand, lower than the flow rate in the line in case of breakage of said line, serves to isolate the downstream portion of the line when the flow rate becomes higher than the threshold flow rate during a line break.

However, for hydraulic circuit operating conditions and in particular for a given fluid temperature, the difference between the highest flow rate in normal operation and the lowest leakage flow rate does not generally guarantee the tripping of the fuse during a leak, particularly when the flow rate generated by the leak is too low due, for example, to a line break far from the fuse and/or in a low cross section zone.

To resolve this difficulty, at least two fuses are arranged in series on the HP discharge line 31 in order to determine segments of said line, called sections, each fuse being arranged on the line at a point upstream of the section.

Each section is determined so that:

the fuse has a threshold flow rate higher than the maximum normal operating flow rate of the consumer equipment units 4 located downstream of the fuse, in case of breakage of the line on the section considered, that is between two successive fuses, the leakage flow rate is higher than the threshold flow rate of the fuse.

The number of fuses required on a line depends on the temperature considered for the hydraulic fluid. This is because the temperature modifies the viscosity of the fluid and in consequence the pressure drops across the fuse. It is these pressure drops that determine the closure of the fuse.

The number of fuses required is therefore commensurately lower as the lower limit of the fluid temperature for which protection must be guaranteed is higher.

In a second embodiment, the closure element 6 is a controlled shutoff valve, called valve, for example a valve controlled by mechanical action.

The valve 6 comprises a first position, called open position, in which the hydraulic fluid flows freely in the corresponding HP discharge line, and a second position, called closed position, in which the hydraulic fluid can no longer flow between a downstream portion, on the pump side of the valve, and an upstream portion, on the side of the hydraulic circuit and the consumer equipment units, of the HP discharge line 31.

The valve 6 is arranged on the HP discharge line 31, preferably outside zones liable to damage by the missile impact, mainly zones close to a heat source, so that said valve does not risk being damaged by the missile impact, and downstream of a bypass 31*a*. The valve is installed for example in a zone of the fuselage or at the wing roots, as close as possible downstream of the bypass 31 which supplies the units whose operation must be preserved.

The HP discharge line 31 of the hydraulic circuit is furthermore equipped with a pressure sensor 9 which delivers data on the pressure of the hydraulic fluid in the corresponding line.

The pressure measured serves to detect the breakage of a line, in consideration of the pressure drops, when, in particular, the flow rate is higher than the maximum normal operating flow rate of the circuit.

Advantageously, the pressure sensor is arranged on the HP discharge line, close to the tip 104 of a wing 101, as shown in FIG. 3. In this case, a break of the HP discharge line at any point located between the valve 6 and the pressure sensor 9 results in a virtually total inhibition of the flow and of the pressure at the sensor 9.

The drop in pressure at the sensor 9 below a minimum value, provided that the hydraulic circuit, and in particular the pump, is not considered to be failing in other respects, is therefore interpreted by a control device 61 as a break in the HP discharge line.

Furthermore, a device 61 for controlling the valve 6 receives signals from the pressure sensor arranged on the HP discharge line of a wing so that when the pressure measured by said sensor is lower than a threshold, adapted to the HP discharge line considered, said control device generates a signal that has the effect of ordering the closure of said valve.

Owing to the virtually instantaneous pressure measurement supplied by the pressure sensor arranged on the line and the rapid drop in pressure in the line caused by the breakage of said line by a missile impact, the detection of a pressure drop by the sensor below the threshold is interpreted by the control system 61 of the valve 6 as a leak in the corresponding line, a possible consequence of a missile impact, and said system orders the closure of the valve 6 on the HP discharge line 31.

Advantageously, the device 61 for controlling the valve 6 receives a signal to inhibit the order to close the valve when the pressure measured by the pressure sensor is normally below the threshold value, in particular during engine startup phases.

The pressure value delivered by a pressure sensor may be an analog or digital value corresponding to a measured value and which is then compared by the control device 61 of the valve 6 to the threshold value associated with said pressure sensor, or by construction of said pressure sensor, a discrete value which changes status for the threshold value.

Advantageously, the HP discharge line is equipped with at least two pressure sensors, preferably in parallel, for measuring the pressure in said line, said sensors each delivering a substantially identical value of the fluid pressure measured in the corresponding line.

In an exemplary embodiment, a "AND" logic function between the two sensors guarantees the measurement of the fluid pressure in the HP discharge line 31 even in case of failure of one of the sensors.

In this second embodiment, a single closure element 6 is necessary to isolate the circuit of a wing because the offset pressure sensor serves to detect the breakage of a pipe at any point of the circuit.

The disclosed embodiments are described in the case of a hydraulic circuit. The disclosed embodiments are advantageously applied to an overall hydraulic architecture comprising two or more hydraulic circuits, simultaneously broken during a missile impact, whereof at least one comprises protection by at least one closure element 6/nonreturn valve 7 combination.

Advantageously, the hydraulic architecture is designed so that at least one hydraulic circuit supplies consumer equipment units distributed on the two wings and so that the aircraft can be controlled in flight, even in very degraded condition, while only using the consumer equipment units of a single wing. In this case, a single hydraulic circuit, corresponding to the circuit supplying the consumer equipment units distributed on the two wings, is equipped with a closure element 6/nonreturn valve 7 combination. However, since the missile may equally well impact one or the other wing of the aircraft, and according to a certain architecture of the hydraulic system onboard an aircraft, closure element 6/nonreturn valve 7 combinations on different hydraulic circuits, for each wing, are preferably used.

Preferably, the hydraulic architecture is defined so that, during an impact on a wing, the protected hydraulic circuit, that is, of which the hydraulic circuit on the side of the wing considered is isolated, is supplied by a pump of an engine of the non-impacted wing, or by any other hydraulic generation means whereof the risk of simultaneous damage is considered low.

Advantageously, the closure of a closure element, fuse or valve, is carried out in a very short period, no longer than a few seconds, after the detection of the impact, to limit the loss of hydraulic fluid, and the tank is designed taking account of the performance of the closure elements.

The pump, the consumer equipment units and the zones of associated lines liable to have been damaged by the missile impact are then isolated from the rest of the hydraulic circuit by the closure element 6, without the loss of a large quantity of hydraulic fluid, and hence keeping the rest of the hydraulic circuit operational.

The isolation of a portion of a HP discharge line of a hydraulic circuit of an aircraft wing only concerns the portion of the circuit bounded by the closure element 6 positioned the furthest upstream of the leak and the tip of the wing considered.

The isolation by the closure elements 6 of a portion of the high pressure lines and by the nonreturn valves 7 of a portion of the low pressure lines of an aircraft wing in a sufficiently short period serves to preserve the fluid in the remaining functional portion of the hydraulic circuit, thanks to the remaining hydraulic pressure generations, and hence to use the consumer equipment units to maintain a minimal aircraft control capacity.

In the examples described below and illustrated in FIGS. 4 to 7*b*, the hydraulic system of the aircraft comprises three independent hydraulic circuits, a first circuit, called green circuit 1*a*, a second circuit, called yellow circuit 1*b*, and a third circuit, called blue circuit 1*c*, which are routed in the airfoil, comprising the left wing and the right wing, in the fuselage and in the tail units. The yellow and blue circuits are each supplied by one pump, while the green circuit is supplied by two pumps.

Figure 4:
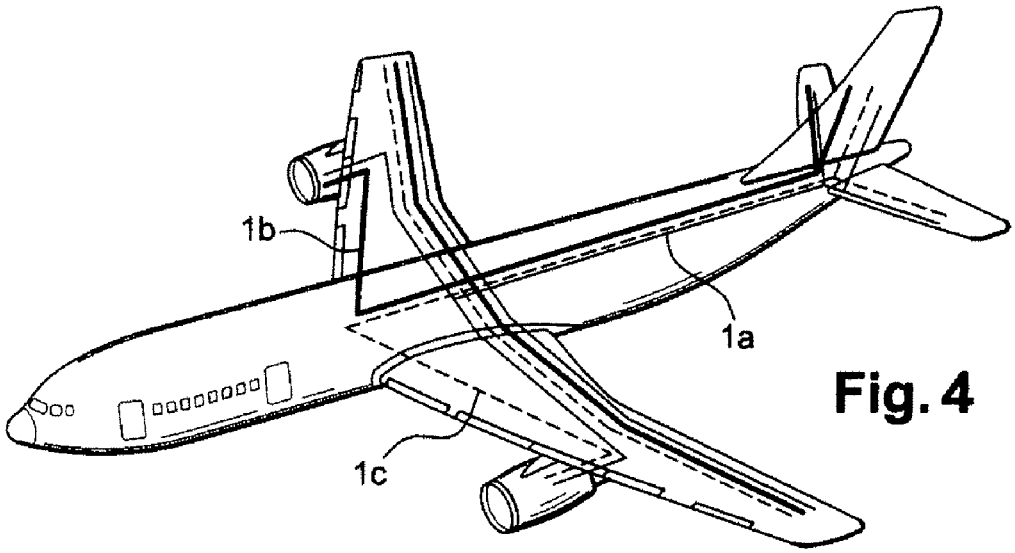

In a first example of the architecture of a hydraulic system of a twin-engined aircraft, illustrated in FIG. 4, two circuits, the yellow circuit 1*b* and the blue circuit 1*c*, are each supplied by a pump driven by a different motor, and the third circuit, the green circuit 1*a*, is supplied by two pumps, each driven by a different motor. The yellow circuit 1*b* is supplied by a pump driven by the motor of the right wing, the blue circuit 1*c* is supplied by a pump driven by the motor of the left wing, the green circuit 1*a* is supplied by a pump driven by the left motor and a pump driven by the right motor.

In the case in which the left wing is struck by a missile, the blue 1*c* and green 1*a* circuits, which are supplied by the pump driven by the motor of the left wing, are considered as lost. The yellow circuit 1*b*, which is supplied by the pump driven by the motor of the right wing, supplies pressurized hydraulic fluid to the consumer equipment units 4 of the left wing, among other units. In a first embodiment, by equipping the portion of the yellow circuit located in the left wing with at least one fuse, and according to the position of an impact on said left wing, the other consumer equipment units of the yellow circuit of the right wing and of the rest of the aircraft, and also those upstream of the fuse which is tripped in the left wing, will continue to be supplied by the pump driven by the motor of the right wing. In another embodiment, by equipping the portion of the yellow circuit located in the left wing with a valve and with at least one pressure sensor, the consumer equipment units of the yellow circuit of the right wing and of the rest of the aircraft will similarly continue to be supplied by the pump driven by the motor of the right wing.

Similarly, to take account of the case in which the right wing is struck, the yellow 1*b* and green 1*a* circuits, which are supplied by the pump driven by the motor of the right wing, are considered as lost. The blue circuit 1*c*, which is supplied by the pump driven by the motor of the left wing, supplies pressurized hydraulic fluid to the consumer equipment units 4 of the right wing, among other units. By equipping the portion of the blue circuit located in the right wing with at least one closure element, the consumer equipment units of the blue circuit located upstream of the closed closure element will continue to be supplied by the pump driven by the motor of the left wing.

Figure 5:
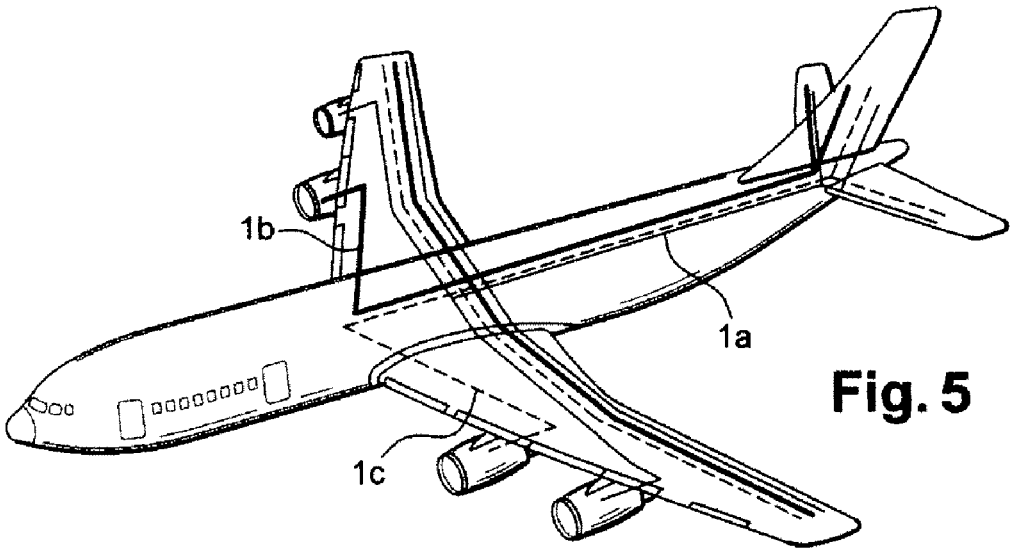

In a second example of the architecture of a hydraulic system of a four-engined aircraft, as shown in FIG. 5, two circuits, the yellow circuit 1*b* and the blue circuit 1*c*, are each supplied by a pump driven by a different motor and the third circuit, the green circuit 1*a*, is supplied by two pumps driven by two other motors. The yellow circuit 1*b* is supplied by a pump driven by one of the two motors of the right wing, the blue circuit 1*c* is supplied by a pump driven by one of the two motors of the left wing, the green circuit 1*a* is supplied by the second motor of the left wing and the second motor of the right wing.

In the case in which the left wing is struck by a missile, the blue 1*c* and green 1*a* circuits, which are supplied by pumps driven by the motors of the left wing, are considered as lost. The yellow circuit 1*b*, which is supplied by the pump driven by one of the motors of the right wing, supplies pressurized hydraulic fluid to the consumer equipment units 4 of the left wing, among other units. In a first embodiment, by equipping the portion of the yellow circuit located in the left wing with at least one fuse, and according to the position of the impact on said left wing, the other consumer equipment units of the yellow circuit of the right wing and of the rest of the aircraft, and also those upstream of the fuse which is tripped in the left wing, will continue to be supplied by the pump driven by the motor of the right wing. In a second embodiment, by equipping the portion of the yellow circuit located in the left wing with a valve and with at least one pressure sensor, the consumer equipment units of the yellow circuit of the right wing and of the rest of the aircraft will similarly continue to be supplied by the pump driven by the motor of the right wing.

Similarly, to take account of the case in which the right wing is struck by a missile, the yellow 1*b* and green 1*a* circuits, which are supplied by pumps driven by the motors of the right wing, are considered as lost. The blue circuit 1*c*, which is supplied by the pump driven by the motor of the left wing, supplies pressurized hydraulic fluid to the consumer equipment units 4 of the right wing, among other units. By equipping the portion of the blue circuit 1*c* located in the right wing with at least one closure element, the consumer equipment units of the blue circuit located upstream of the closed closure element will continue to be supplied by the pump driven by the motor of the left wing.

Example of positioning of fuses on an airfoil

Figures 6A, 6B:
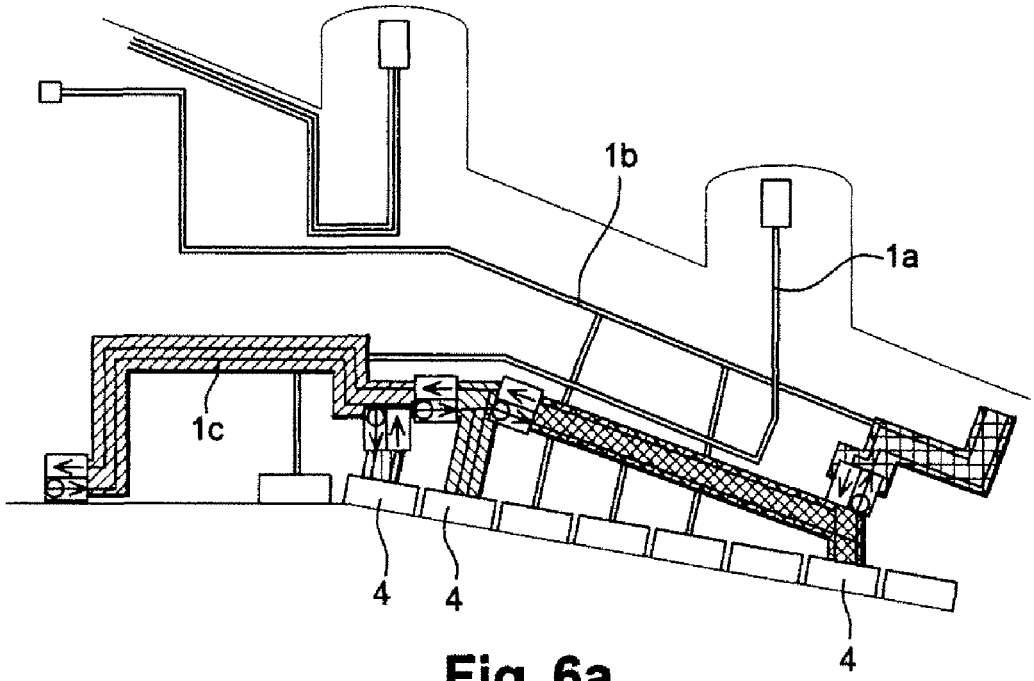

By way of a nonlimiting illustration of the disclosed embodiments, and based on the hydraulic system architecture shown in FIG. 5 for a four-engined aircraft, FIG. 6*a* shows an example of the position of the fuses 6 on the HP discharge line 31 of the blue circuit 1*c* and of the nonreturn valves 7 on the return line 34 of the blue circuit 1*c* in a right wing of the four-engined aircraft, and the uniform flow rate section associated with each fuse, for a lower fluid temperature limit of −15° C. To take account of the various events for the HP discharge line 31 of the blue circuit 1*c* of the right wing, at this temperature, five fuses are required.

FIG. 6*b* shows a table illustrating the characteristics of the circuit and of the fuses of which the trip thresholds are a function of the flow rates of the sections of circuits in normal operation and in case of line breakage.

Figures 7A, 7B:
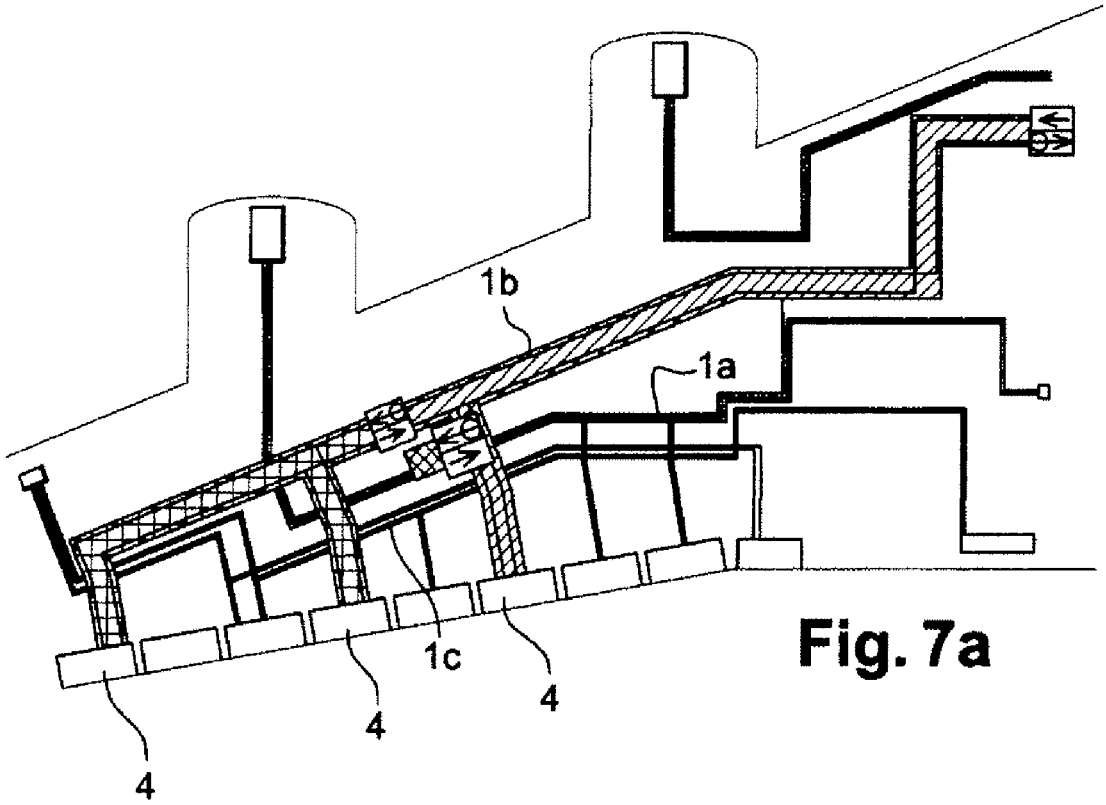

By way of a nonlimiting illustration of the disclosed embodiments, based on the hydraulic system architecture shown in FIG. 5 for a four-engined aircraft (intercontinental), FIG. 7*a* shows an example of a position of the fuses 6 on the HP discharge line 31 of the yellow circuit 1*b* and of the nonreturn valves 7 on the return line 34 of the yellow circuit 1*b* in a left wing of the four-engined aircraft and the uniform flow rate section associated with each fuse, for a lower fluid temperature limit of −15° C. To take account of the various events for the HP discharge line of the yellow circuit 1*b* of the left wing, at this temperature, three fuses are required.

FIG. 7*b* shows a table illustrating the characteristics of the circuit and of the fuses of which the trip thresholds are a function of the flow rates of the sections of circuits in normal operation and in case of line breakage.

The disclosed embodiments therefore serve to improve the controllability of the aircraft during a missile impact on the airfoil, while keeping the consumer equipment units of the non-impacted wing of the airfoil operational, as well as those of the aft portion of the aircraft, drift and depth, and thereby prevent a catastrophic situation from occurring.

What is claimed is:

1. A hydraulic system comprising at least one hydraulic circuit said hydraulic circuit comprising:

at least one hydraulic pump for generating a high pressure flow of a hydraulic fluid of the at least one hydraulic circuit, said pump defining a direction upstream of the hydraulic circuit, one or more consumer equipment units of a first zone using the hydraulic fluid, said consumer equipment units defining a direction downstream of the hydraulic circuit, at least one HP discharge line in which the hydraulic fluid flows from the pump to the consumer equipment units, said HP discharge line comprising at least one bypass consumer equipment units of a second zone, in which second zone the hydraulic pump is located, said bypass being located between, on the one hand, the pump and, on the other hand, the consumer equipment units, at least one return line in which the hydraulic fluid flows from the consumer equipment units to a hydraulic tank, said return line comprising at least one bypass to consumer equipment units of a second zone, said bypass being located between, on the one hand, the tank and, on the other hand, the consumer equipment units, wherein the hydraulic system comprises:

at least two fuses, on the at least one HP discharge line of the at least one hydraulic circuit between, on the one hand, the bypass and, on the other hand, the consumer equipment units, the second fuse being located downstream of the first, at least two nonreturn valves on the at least one return line of the at least one hydraulic circuit between, on the one hand, the bypass and, on the other hand, the consumer equipment units, and opposing the flow of the fluid from the pump to the consumer equipment unit, each fuse comprising an open position in which the hydraulic fluid flows freely in the HP discharge line from upstream to downstream of said fuse in a normal operating mode of the hydraulic circuit and comprising a closed position in which the hydraulic fluid is prevented from flowing from upstream to downstream of said fuse, each fuse being placed automatically in the closed position when a break of the HP discharge line is detected downstream of said fuse of said HP discharge line, and each fuse is normally open and closes, without external action, when a flow rate of fluid passing through the line at said fuse is higher than a predefined threshold flow rate, characteristic of the rating of the fuse concerned.

2. The hydraulic system as claimed in claim 1, in which a distance between two consecutive fuses on an HP discharge line is such that:

the rating of the fuse is at least higher than the maximum normal operating flow rate of all the consumer equipment units located downstream of the fuse, the rating of the fuse is lower than the flow rate in case of breakage of the HP discharge line downstream of the fuse and upstream of the next downstream fuse.

3. The hydraulic system as claimed in claim 2, in which the number and arrangement of the fuses are such that a break at any point of an HP line causes the closure of a fuse upstream of the break on said HP line.

4. The hydraulic system as claimed in claim 3, in which the number and arrangement of the fuses are determined for a given temperature of the hydraulic fluid.

5. An aircraft comprising at least two hydraulic circuits, each circuit supplying consumer equipment units which are specific to it and in which at least one circuit comprises lines in the two wings of said aircraft and belongs to a hydraulic system as claimed in claim 1.

6. A hydraulic system comprising at least one hydraulic circuit said hydraulic circuit comprising:

at least one hydraulic pump for generating a high pressure flow of a hydraulic fluid of the at least one hydraulic circuit, said pump defining a direction upstream of the hydraulic circuit, one or more consumer equipment units of a first zone using the hydraulic fluid, said consumer equipment units defining a direction downstream of the hydraulic circuit, at least one HP discharge line in which the hydraulic fluid flows from the pump to the consumer equipment units, said HP discharge line comprising at least one bypass to consumer equipment units of a second zone, in which second zone the hydraulic pump is located, said bypass being located between, on the one hand, the pump and, on the other hand, the consumer equipment units, at least one return line in which the hydraulic fluid flows from the consumer equipment units to a hydraulic tank, said return line comprising at least one bypass to consumer equipment units of a second zone, said bypass being located between, on the one hand, the tank and, on the other hand, the consumer equipment units, the hydraulic system comprising:

at least one controlled valve, on the at least one HP discharge line of the at least one hydraulic circuit between, on the one hand, the bypass and, on the other hand, the consumer equipment units, at least one nonreturn valve on the at least one return line of the at least one hydraulic circuit between, on the one hand, the bypass and, on the other hand, the consumer equipment units, and opposing the flow of the fluid from the pump to the consumer equipment units, said at least one controlled valve comprising an open position in which the hydraulic fluid flows freely in the HP discharge line from upstream to downstream of said controlled valve in a normal operating mode of the hydraulic circuit and comprising a closed position in which the hydraulic fluid is prevented from flowing from upstream to downstream of the controlled valve, said controlled valve being placed automatically in the closed position when a break of the HP discharge line is detected downstream of the controlled valve of said HP discharge line, wherein the valve is controlled when a signal from at least one pressure sensor detects a pressure lower than a predefined threshold in a HP discharge line at a point close to a consumer equipment unit among the furthest from the controlled valve, and wherein the at least one sensor is positioned on a HP discharge line close to one tip of an aircraft wing.

7. An aircraft comprising at least two hydraulic circuits, each circuit supplying consumer equipment units which are specific to it and in which at least one circuit comprises lines in two wings of said aircraft and belongs to a hydraulic system as claimed in claim 6.

* * * * *